US005634843A

United States Patent [19]

Liu

[11] Patent Number: 5,634,843

[45] Date of Patent: Jun. 3, 1997

[54] MULTI-FUNCTIONAL GRINDING WIPER

[76] Inventor: Te-Hsi Liu, 33 Tunghsing Road, Tunghai Village, Chupei Hsiang, Hsinchu Hsien, Taiwan

[21] Appl. No.: 373,388

[22] Filed: Jan. 17, 1995

[51] Int. Cl.[6] ..... B24B 23/00

[52] U.S. Cl. ..... 451/344; 451/456; 451/524

[58] Field of Search ..... 451/354, 344, 451/523, 524, 525, 456, 450, 488

[56] References Cited

U.S. PATENT DOCUMENTS

| | | | |
|---|---|---|---|
| 4,137,670 | 2/1979 | Goralski | 451/524 |
| 4,759,155 | 7/1988 | Shaw | 451/354 |
| 4,779,385 | 10/1988 | Retter | 451/354 |
| 4,937,984 | 7/1990 | Taranto | 451/354 |
| 5,309,681 | 5/1994 | Cheney et al. | 451/344 |
| 5,402,559 | 4/1995 | Allison et al. | 451/524 |

FOREIGN PATENT DOCUMENTS

| | | | |
|---|---|---|---|
| 0319729 | 6/1989 | European Pat. Off. | 451/456 |
| 0549202 | 6/1993 | European Pat. Off. | 451/450 |
| 2470660 | 6/1981 | France | 451/344 |
| 3001913 | 2/1993 | WIPO | 451/523 |

*Primary Examiner*—Robert A. Rose

*Attorney, Agent, or Firm*—Beveridge, DeGrandi, Weilacher & Young, L.L.P.

[57] ABSTRACT

A multi-functional grinding wiper including a stand of wiper, an aluminum plate, and an emery. The upper part of the grinding wiper is a wavelike shape designed according to physical maneuverability. There is a connector at an end of the wiper connecting a hose or dust cleaning tube. Each orifice at the bottom of the wiper has it's own channel pointing directly to the connector, thus water from the connector can be sprinkled or dust powder can be cleaned up through the tube evenly. The bottom of the wiper is caulked by an aluminum plate stuck with a self-adhesive tape which snaps the fluffy part of the emery sheet so that it may adhere tightly to the grinding wiper stand.

5 Claims, 7 Drawing Sheets

MULTI-FUNCTIONAL GRINDING WIPER

INTRODUCTION AND BACKGROUND

The invention is concerning a multi-functional grinding wiper for hosing cars and cleaning dust powder used in car beautifying and coating.

A grinding wiper conventionally used in car beautifying and coating is wrapped round with an emery on both sides. In order to avoid abrasion between the fuzzy side of the emery and the wiper, we must fold the emery in folio on both sides of the wiper with the emery facing outwards. In application we have to hold tight of the wiper stand on both sides folded with emery by the hand in grinding so that slips may not happen during operation. Thus, the defects of a conventional wiper occurring in grinding are as follows:

1. It will cause a great deal of dust powder when a dry grinding is applied. This is harmful to the operator's health.
2. Dust powder may spread on the surface of the emery during the operation of dry grinding. This may reduce the effect of the work.
3. If a wet grinding is applied, the operator has to use a wet towel or add water as an accessory. This is very inconvenient for the operator.
4. It is a waste to use the emery because only part of it can be used in application.
5. The abrasion effect between the folded emery sheet and the wiper makes the wiper surface uneven. This also makes the surface ground surface uneven.
6. An operator's hand may become callous because of the direct contact between his fingers and the emery during operation.

SUMMARY OF THE INVENTION

The multi-functional grinding wiper includes a wiper stand, an aluminum plate, and an emery. The upper part of the grinding wiper is a wavelike shape designed according to physical manoeurability. There is a connector at an end of the wiper connecting a hose or dust cleaning tube. Each orifice at the bottom of the wiper has its own channel pointing directly to the connector, thus water from the connector can be sprinkled or dust powder can be cleaned up through the tube evenly. The bottom of the wiper is caulked by an aluminum plate sticked with a self-adhesive tape which snaps the fluffy part of the emery sheet so that it may adhere tightly to the grinding wiper stand.

BRIEF DESCRIPTION OF THE DRAWINGS

The present invention will be further understood with reference to the drawing, wherein.

DETAILED DESCRIPTION OF THE INVENTION

The object of the invention is to offer a multi-functional grinding wiper which comprises a hosing device and dust cleaning tube. The invention is based on physical manoeuvrability. By the arrangement of channels in the wiper each orifice at the bottom of the wiper has a passage passing slantwise to the wiper stand. Water supply and dust cleaning operations are done through these passages. The water supplied from the connector may sprinkle evenly on the grinding surface of the wiper. Dust and scraps are also absorbed and cleaned through the channels. Besides, a self-adhesive tape adheres to the aluminum prate that is coherent to the stand of the wiper, thus snaps the fuzzy part of an emery by its proboscislike surface. This holds the emery at the bottom of the wiper. The merits of this invention are as below:

1. It absorbs dust, thus reduces contamination.
2. The ground dust powder ground does not stick to the emery so easily as a conventional wiper makes
3. Water may be supplied through the connector of the wiper and sprinkled evenly at its bottom. It is unnecessary to carry a water hose or wet towel during operation
4. The bottom of the wiper stand snaps an aluminum plate. This helps the ground surface become evener.
5. The operator's hand does not touch the emery directly, so his hand is not going to be callous.
6. The emery can be fully used. There will be no waste in use of emery.
7. The design of the wiper stand is based on physical manoeuvrability. No occupational hazards are likely to occur.

According to the statement listed above, the invention has corrected defects of a conventional grinding wiper. It is an innovative invention and is a multi-functional one. With these merits and defects between the invention and a conventional one we can see that it is truly a delicate invention. In order to help examiners to be familiar with the function of the invention and its structure further, we have prepared the following description and the drawings.

Figure 1:
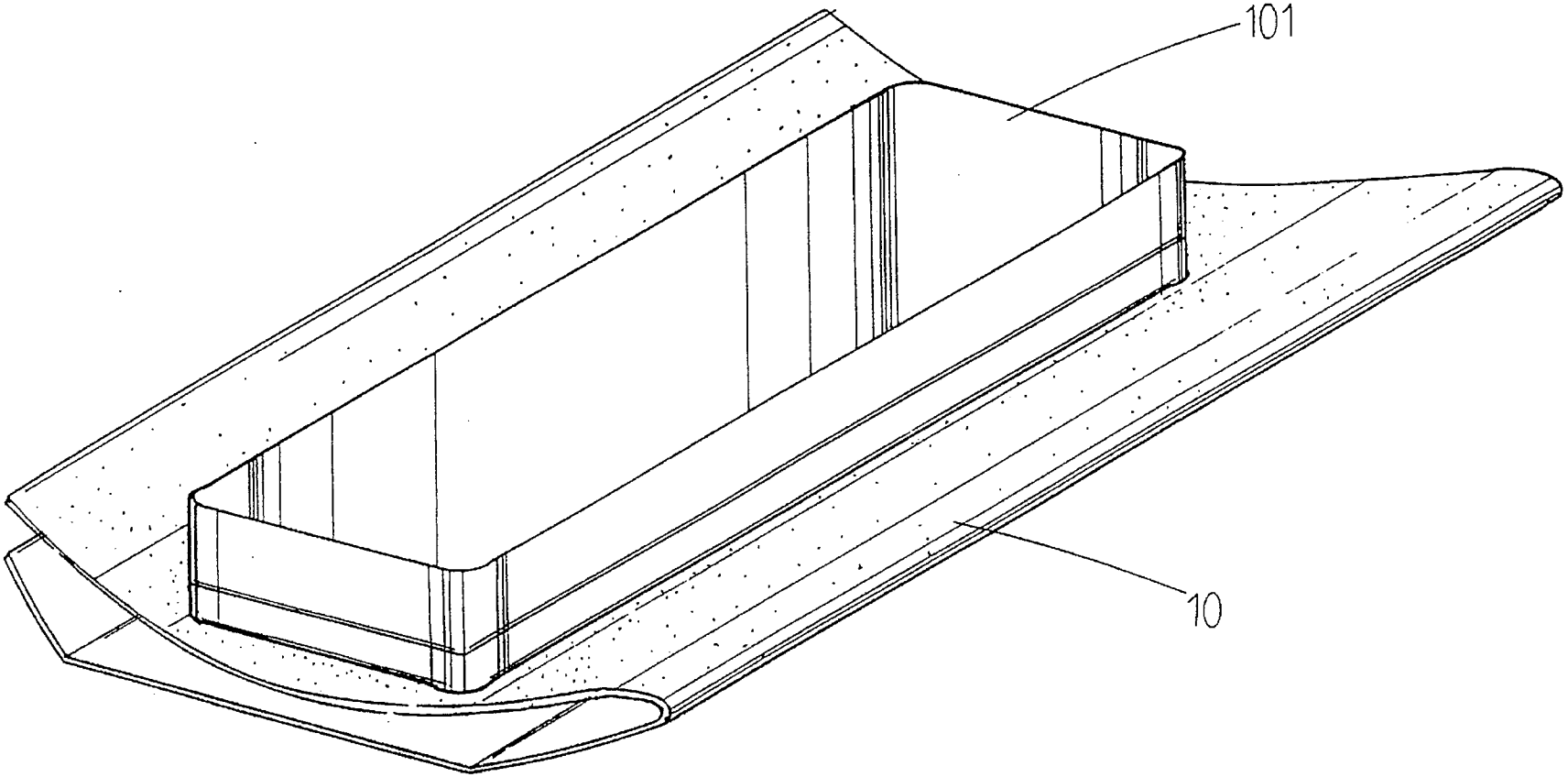
FIG. 1 is a diagram of a conventional grinding wiper.

FIG. 1 is a diagram of a conventional grinding wiper. An emery(10) wraps both sides and the bottom part of the wiper(101). In order to avoid sliding between the flat surface of the emery(10) and the wiper(101), the operator has to fold a sheet of emery(10) in folio round the wiper(101) evenly with carborundum facing outwards. The operator must exert forces on the wiper(101) wrapped in emery and grip tightly on both sides of the emery(10) sheet so that it may not slip away during grinding operation. There are several defects in the designing. The operator's hand will become callous because of the direct contact between the emery(10) and him. In addition, the sheet of emery can be used only in folio, which means that part of it will be a waste. Besides, the folded part of the emery(10) that contacts the wiper(101) will abrade the surface of the wiper(101) as the whole set is in grinding operation, and the dust ground powder is harmful to the operator's health.

Figure 2:
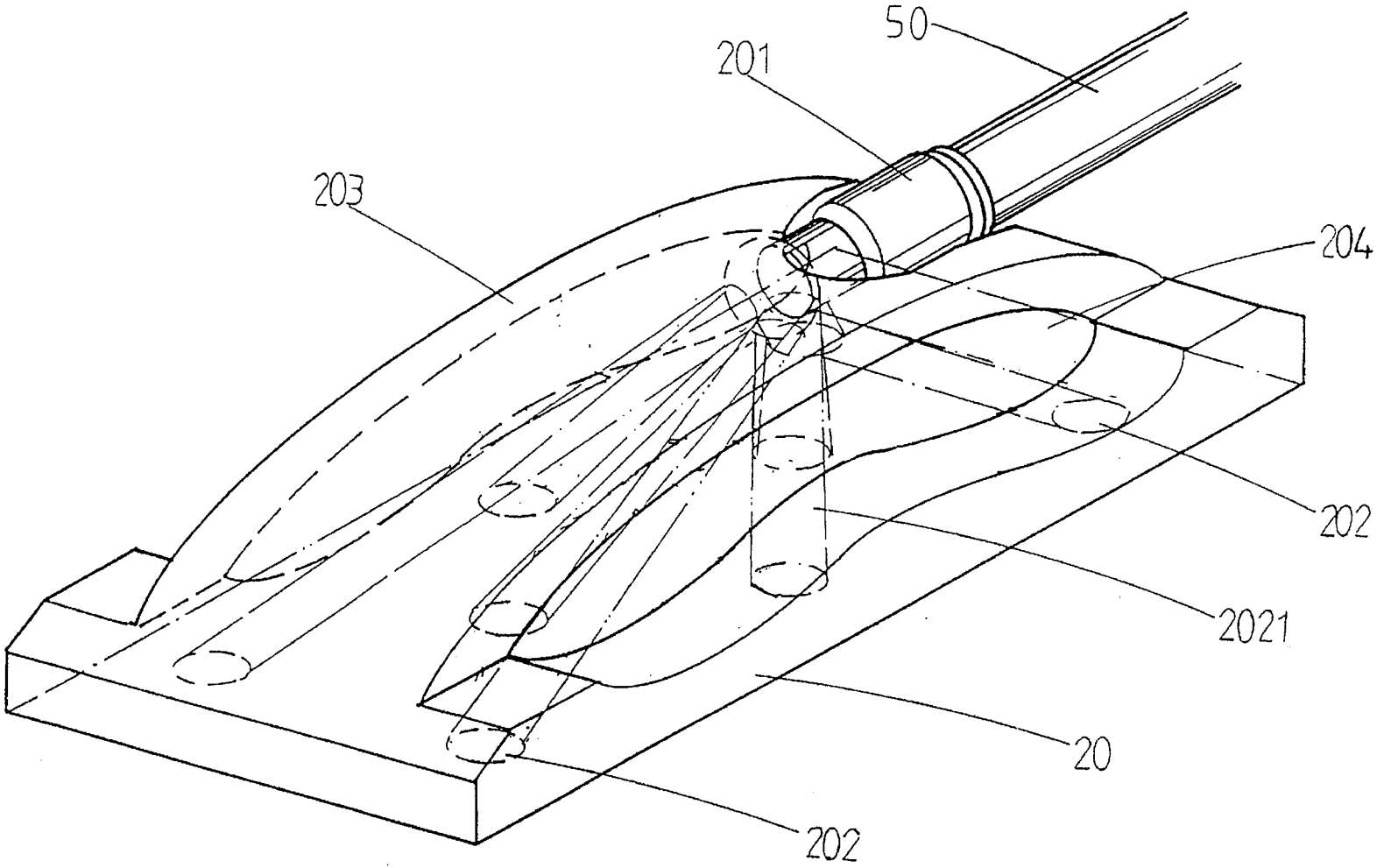
FIG. 2 is a perspective view of the wiper stand of the invention.

FIG. 2 is a perspective diagram of the invention. There is a rib(203) at the top of the wiper stand(20), and two concavities(204) are on either side of the wiper. The operator can hold them fast in grinding without difficulty. Each side of the wiper stand(20) has a wavelike shape that is designed according to physical manoeuvrability. The operator will fee all right with the wiper when using it. A connector(201) for connecting a hose or dust cleaning tube(50) is at an end of the wiper stand(20) with orifices(202) at its bottom. There are passages(2021) arranged slantwise lying between the orifices(202) and the connector(201) for sprinkling water evenly on the bottom surface of the wiper stand(20), or cleaning dust in grinding operation.

Figure 3:
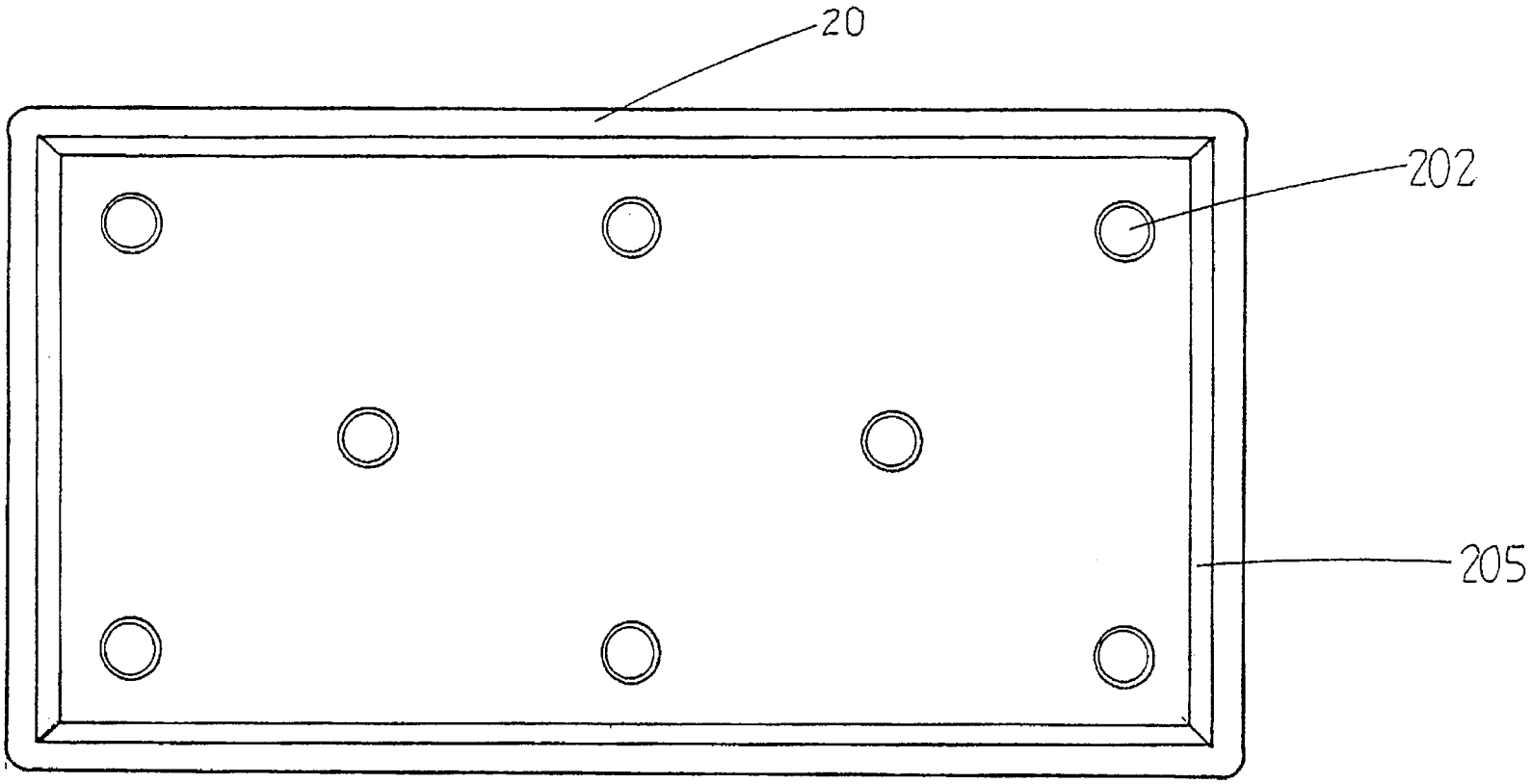
FIG. 3 is a bottom view of the invention.
Figure 4:
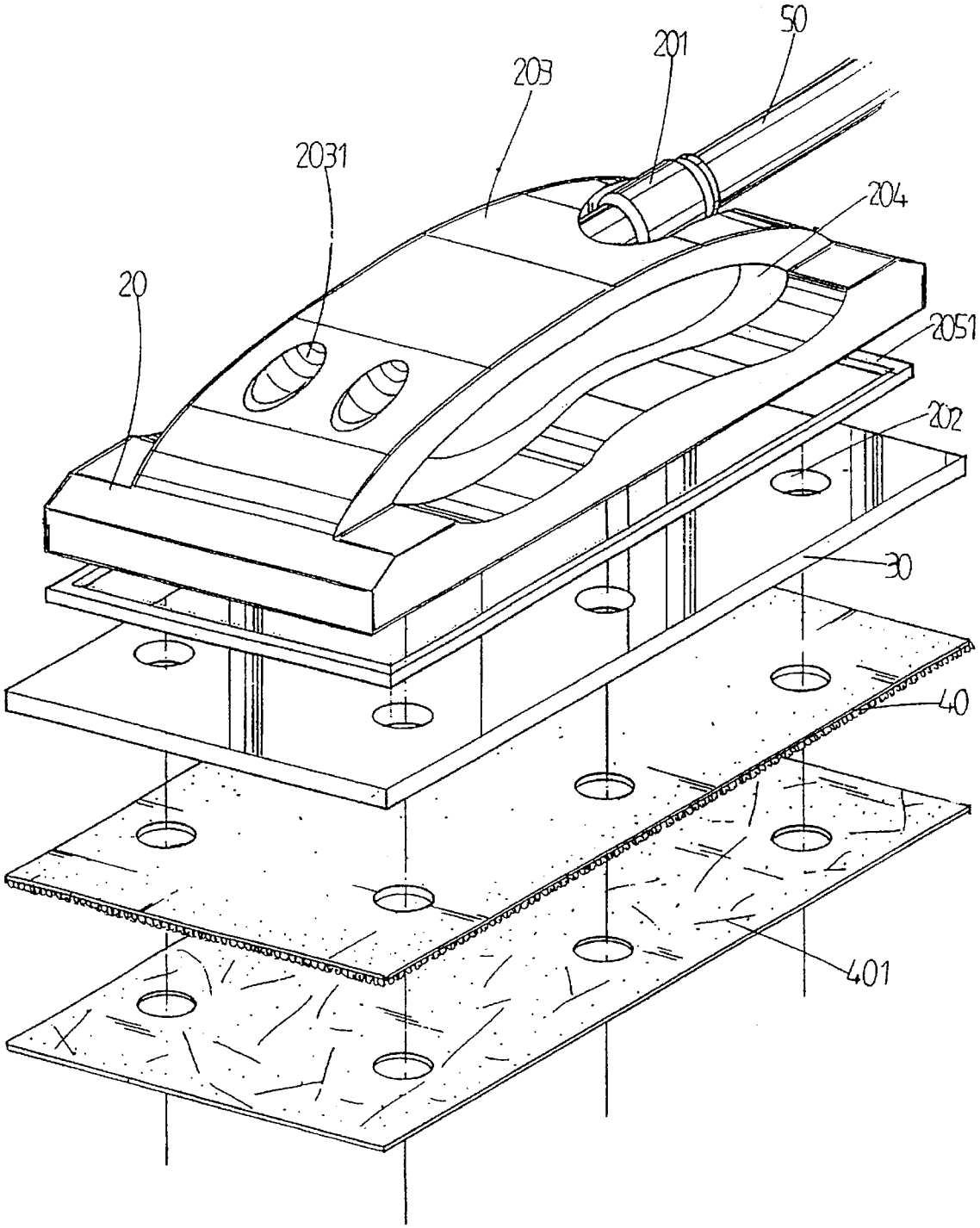
FIG. 4 is a fragmentary diagram of the invention.
Figure 5:
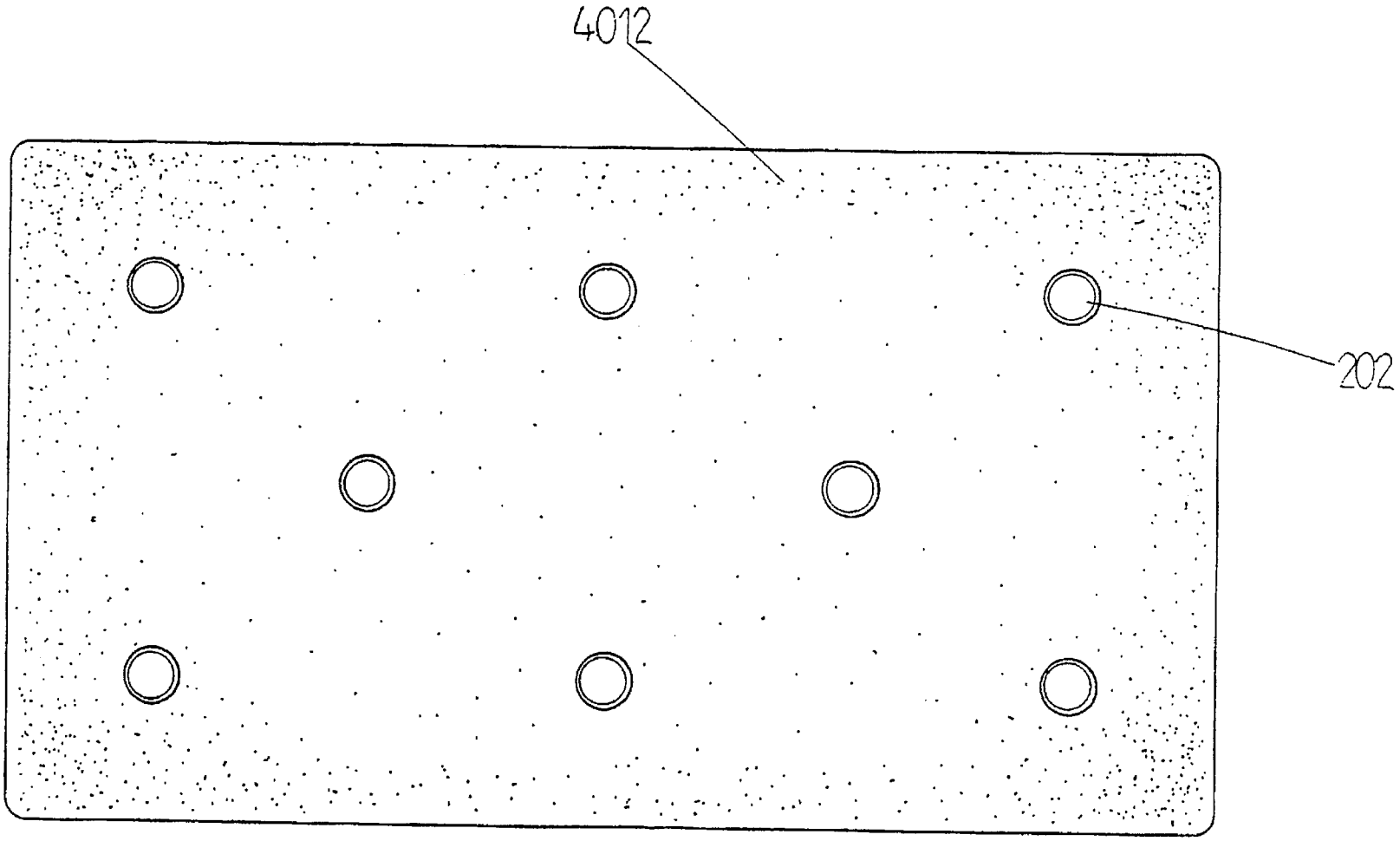
FIG. 5 is an upward perspective of the invention.

FIG. 3 is an upward perspective view of the wiper stand of the invention. There is a groove(205) at the bottom of the wiper stand(20), and a ring of washer(2051) is embeded in the groove(205) so that water or dust powder will not brim over the sides of the wiper stand(20), as shown in FIG. 4. An aluminum plate(30) is coherent to the bottom of the wiper stand(20). The ground area may be maintained evenly by the hardness of the aluminum plate(30). A self-adhesive tape having a proboscislike surface(40) coherent to a fuzzy area(401) at its bottom sticks to the bottom of the aluminum plate(30). A surface coated with carborundum(4012) is at the back of the fuzzy area(401) (See FIG. 5). Passages of the orifices(202) are arranged through this carborundum surface (4012) to the wiper stand(20). When the operator is grinding, water can be sprinkled evenly on the carborundum surface (4012) from the connector(201). of the wiper stand(20) to all orifices(202), or dust powder from the grinding be absorbed through them hence wipe off the dust on the carborundum surface(4012). Thus, the utility of the carborundum surface (4012) may be extended. The carborundum surface (4012) sticks to the wiper stand(20) through the adhesion of the fuzzy surface(401) to a self-adhesive tape, As the carborundum surface(4012) is worn out, just tear away the fuzzy area(401) from the proboscislike surface(40) of the aluminum plate(30) and stick a new piece of carborundum surface (4012) to it by adhering the fuzzy area(401) to the proboscislike surface(40), hence no waste will occur at all.

Figure 6:
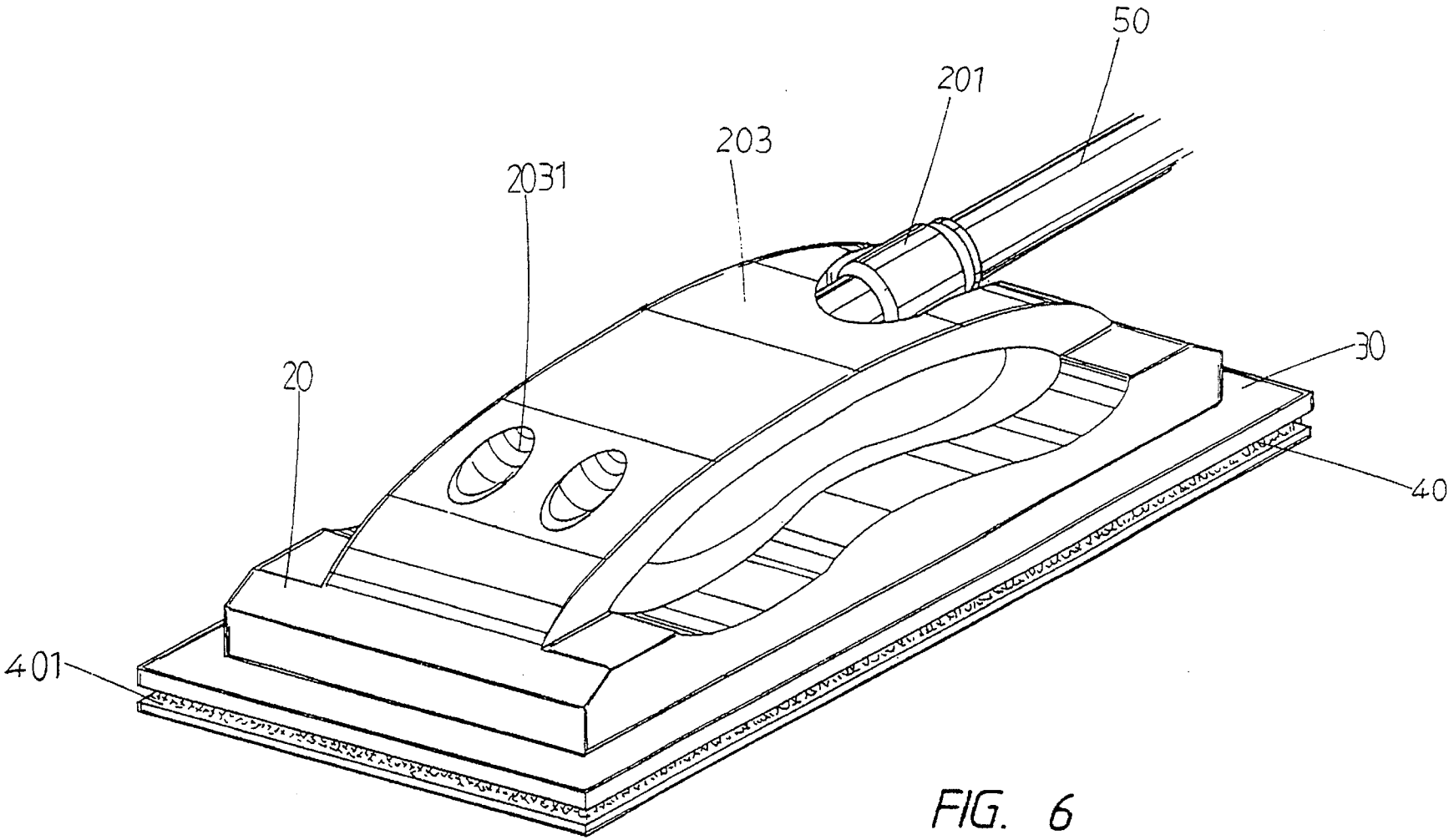
FIG. 6 is assembly diagram of the invention.

FIG. 6 is an assembly diagram of the invention. There are two cavities(2031) about 2 fingers' wide each which are carved in front of the rib(203) of the wiper stand(20). The operator can easily exert forces and hold the wiper stand(20) at will in grinding. The operator's hand does not touch the emery directly, so skin may not get hurt by the grinding work. The connector(201) at an end of the wiper stand(20) Connects a hose or cleaning tube(50). The operator needs not use a wet towel or hose manually instead. If working outdoors, he may bind the hose or cleaning tube(50) to his elbow by a piece of tape thus water may be sprinkled and dust powder be cleaned up utterly.

Figure 7:
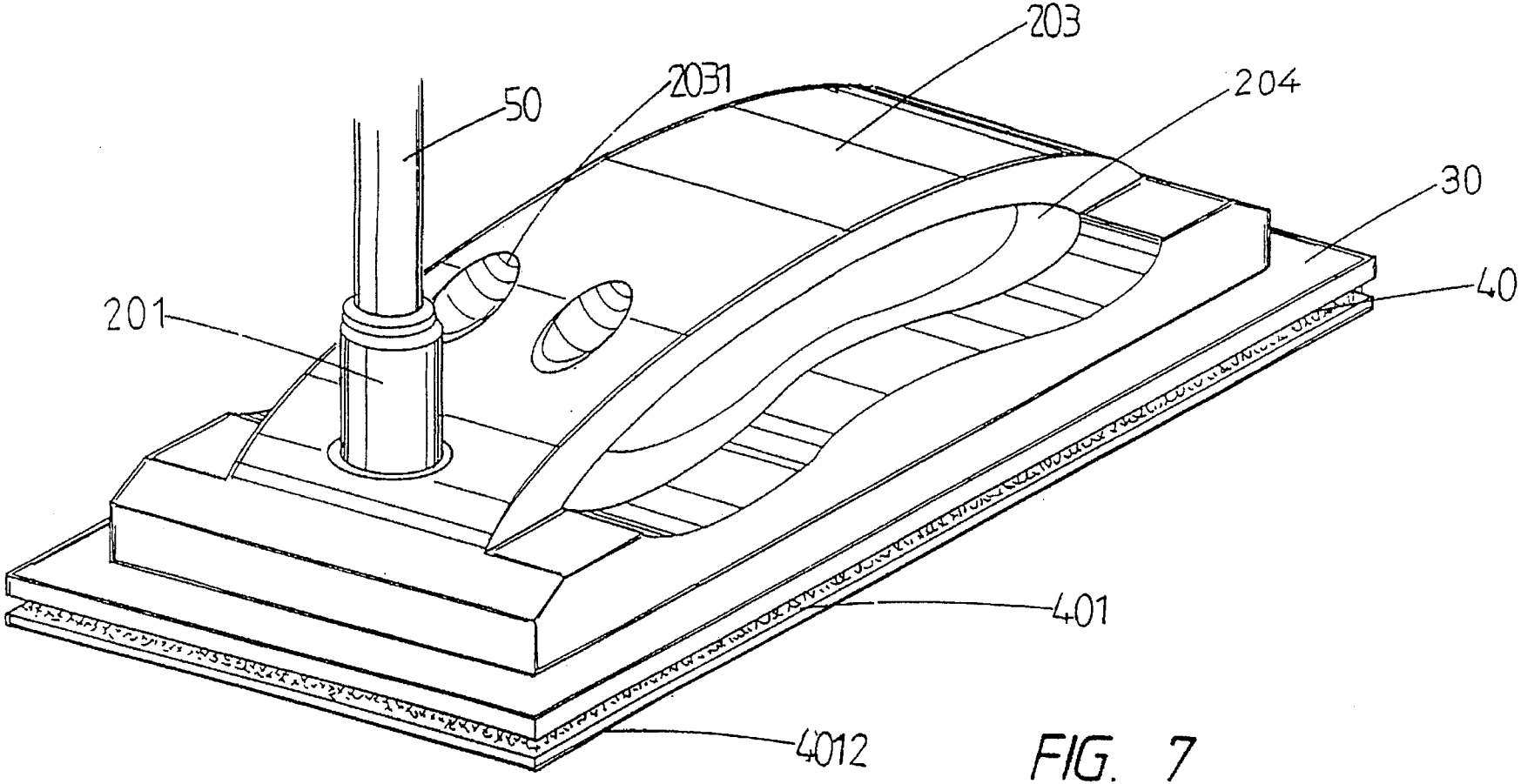
FIG. 7 is an exemplification of the invention.

FIG. 7 is an exemplification of the invention. The connector(201) is placed in front of the wiper stand(20) with the opening facing upwards. This is helpful to indoor operation because most of hoses and air conditioning pipes in car beautifying shops are coming down from the top, and two cavities(2031) are carved in back of the connector(201), which are conducive to hand exertion on the wiper stand (20).

As a summary, it is obvious that the invention is a creative and innovative one that has not been seen in any publications publicly. It complies with the requirements of Patent Law. Though the embodiment of the invention has been disclosed in detail for illustrative purposes, it will be recognized that variations or modifications of the disclosed content lie within the scope of the present invention.

I claim:

1. A multi-functional grinding wiper comprising a wiper stand having at one end thereof a connector adapted for connection to a hose, said wiper stand having a central rib with a concavity on both sides of said rib, said wiper stand having a plurality of holes on its bottom surface in communication with passages arranged slantwise within said wiper stand, said passages being in communication with said connector, a first layer of aluminum secured to the bottom surface of said wiper stand, said first layer having a plurality of holes corresponding to and in communication with said holes of said wiper stand, a second layer having self-adhesive tape on one side thereof and hooks and loops on the other side, said self-adhesive tape secured to the bottom surface of said first layer of aluminum, said second layer having a plurality of holes corresponding to and in communication with said holes in said first layer of aluminum, a third layer having hooks and loops on one side thereof and carborundum on the other side, said hooks and loops of said third layer being in engagement with said hooks and loops of said second layer, said third layer having a plurality of holes corresponding to and in communication with said holes in said second layer, said grinding wiper having the carborundum surface of said third layer facing outwardly from the bottom of said wiper.

2. A multi-functional grinding wiper according to claim 1, wherein said connector of the wiper stand is located in front, facing upward.

3. A multi-functional grinding wiper according to claim 1, wherein said connector of the wiper stand is located in back, facing backward.

4. A multi-functional grinding wiper according to claim 1, wherein two notches in two fingers' span are carved on the front of said rib.

5. A multi-functional grinding wiper according to claim 1, wherein said wiper stand has a wavelike shape.

* * * * *